US007300246B2

(12) United States Patent
Durocher et al.

(10) Patent No.: US 7,300,246 B2
(45) Date of Patent: Nov. 27, 2007

(54) INTEGRATED TURBINE VANE SUPPORT

(75) Inventors: Eric Durocher, Vercheres (CA); John Walter Pietrobon, Outremont (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 231 days.

(21) Appl. No.: 11/011,181

(22) Filed: Dec. 15, 2004

(65) Prior Publication Data

US 2006/0127215 A1 Jun. 15, 2006

(51) Int. Cl.
*F01D 9/00* (2006.01)

(52) U.S. Cl. ..... 415/191; 415/209.3

(58) Field of Classification Search ..... 415/189, 415/190, 191, 209.2, 209.3, 209.4; 416/192
See application file for complete search history.

(56) References Cited

U.S. PATENT DOCUMENTS 3,635,586 A 1/1972 Kent et al.
4,348,157 A 9/1982 Campbell et al.
4,889,469 A 12/1989 Wilkinson
5,149,250 A * 9/1992 Plemmons et al. ..... 415/209.3
5,252,026 A 10/1993 Shepherd
5,372,476 A * 12/1994 Hemmelgarn et al. ..... 415/135
5,429,478 A 7/1995 Krizan et al.
5,545,004 A 8/1996 Ho et al.
6,077,035 A 6/2000 Walters et al.
6,095,750 A * 8/2000 Ross et al. ..... 415/189
7,121,793 B2 * 10/2006 Correia ..... 415/191

* cited by examiner

*Primary Examiner*—Edward K. Look
*Assistant Examiner*—Devin Hanan
(74) *Attorney, Agent, or Firm*—Ogilvy Renault LLP

(57) ABSTRACT

A unitary component for retaining a vane ring in a gas turbine engine comprises a retaining plate portion to restrain axial vane movement, a retaining ring portion to restrain circumferential vane movement, and a baffle portion to split a cooling air flow between the vane and an adjacent rotor.

16 Claims, 5 Drawing Sheets

INTEGRATED TURBINE VANE SUPPORT

TECHNICAL FIELD

The invention relates generally to gas turbine engines and, more particularly, to the integration of a number of turbine components into a unitary component.

BACKGROUND OF THE ART

Conventional turbine vane inner supporting systems generally comprise at least two distinct components, namely a retaining ring for circumferentially and radially restraining the vanes and a retaining plate for holding the vanes axially in place. Furthermore, a separate baffle plate has to be provided for controlling cooling air flow between the turbine vanes and the adjacent turbine rotor. As gas turbine engine size decreases, the cost, weight and tolerances of such a multi-part assembly becomes significant.

Accordingly, there is a need to provide a new turbine vane support, which provides cost, weight and tolerance savings.

SUMMARY OF THE INVENTION

It is therefore an object of this invention to provide a new turbine vane support which addresses the above-mentioned concerns.

In one aspect, the present invention provides a unitary component for retaining a vane ring in a gas turbine engine, the unitary component comprising a retaining plate portion to restrain axial vane movement, a retaining ring portion to restrain at least one of a circumferential vane movement and a radial vane movement, and a baffle portion to split a cooling air flow between the vane and an adjacent rotor.

In another aspect, the present invention provides a turbine vane assembly for a gas turbine engine, comprising a vane ring mounted about an inner vane ring support via a tongue-and-groove joint, the tongue-and-groove joint including at least one blind groove with a closed axial end for restraining said vane ring against axial movement.

In another aspect, the present invention provides a turbine vane support for supporting a turbine vane ring in a gas turbine engine, comprising a mounting ring portion having a series of circumferentially spaced-apart lug seats defined therein, said lug seats having an integral axially arresting surface.

In another aspect, the present invention provides a turbine vane support in combination with a turbine vane ring having a plurality of circumferentially spaced-apart vane lugs extending radially inwardly from an inner annular band thereof, the inner vane ring support having a plurality of circumferentially spaced-apart blind slots defined in an axially facing surface thereof for receiving the vane lugs in a tongue-and-groove fashion, said blind slots being substantially closed at one axial end thereof to restrain the vane ring against axial movement.

In another aspect, the present invention provides a unitary vane ring for use with an annular support having a plurality of circumferentially spaced-apart blind slots defined in an axially facing surface thereof and having a substantially closed axial face; the unitary vane ring comprising a plurality of circumferentially spaced-apart vanes having an airfoil portion extending radially between inner and outer annular bands, and a plurality of circumferentially spaced-apart vane lugs extending radially inwardly from said inner annular band, said vane lugs adapted to be received in tongue-and-groove engagement in said blind slots with said vane lugs in axial arresting contact with the substantially closed axial face of the blind slots.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
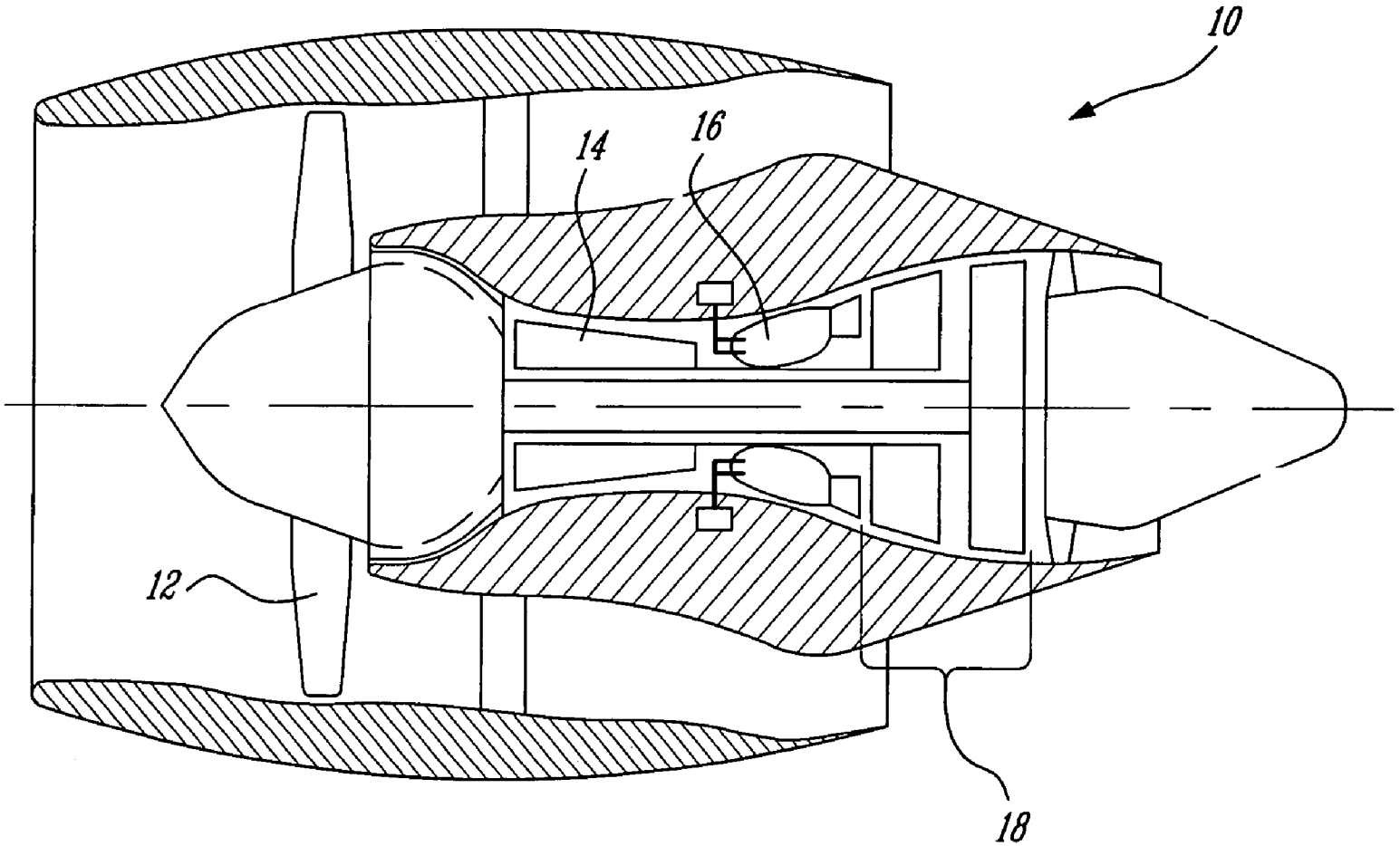
FIG. 1 is a schematic axial cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
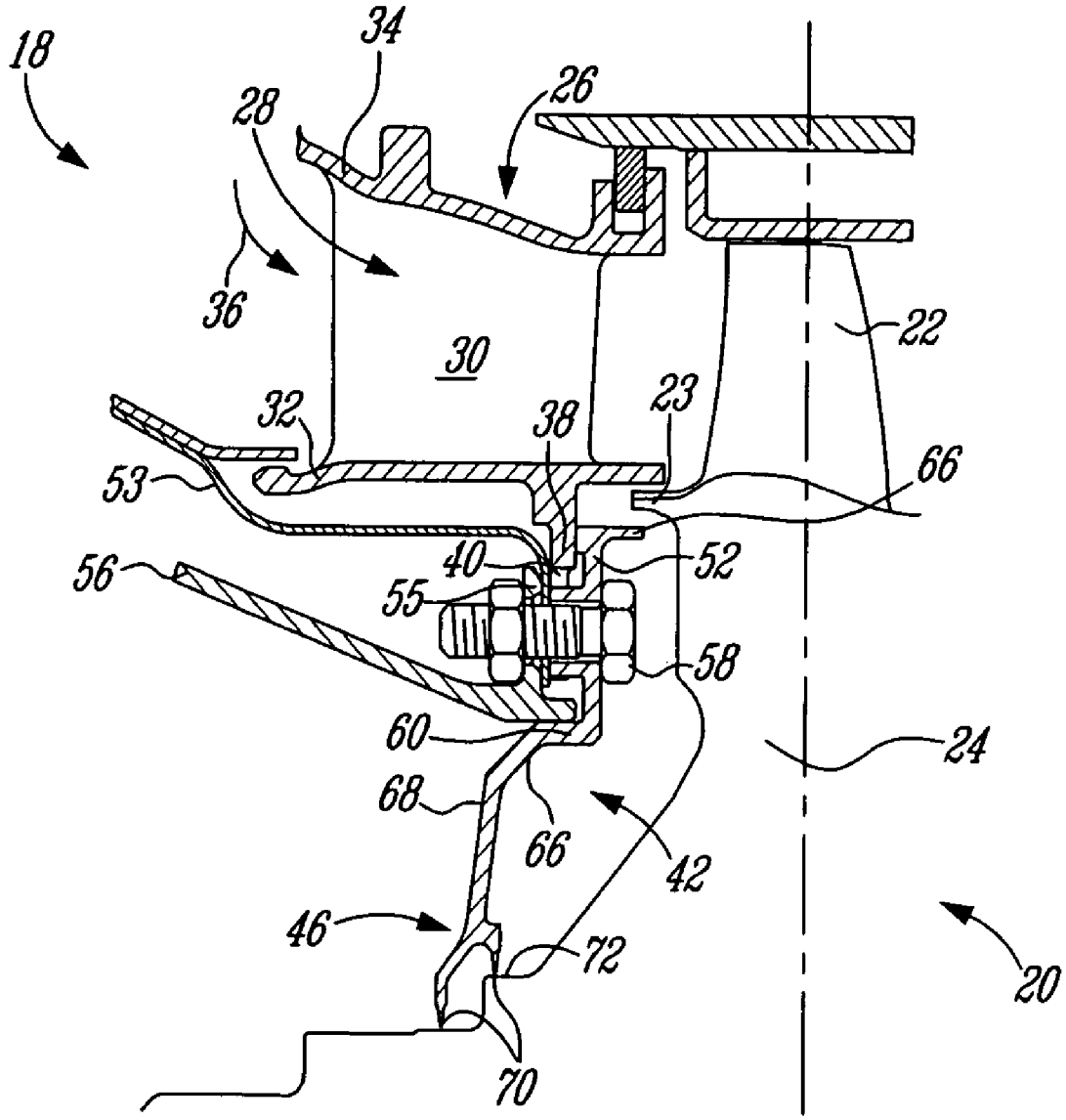
FIG. 2 is an axial cross-sectional view of a portion of the turbine section of the gas turbine engine shown in FIG. 1.

As shown in FIG. 2, the turbine section 18 comprises, among others, a high pressure turbine rotor 20 mounted for rotation about a centerline axis (not shown) of the engine 10. The turbine rotor 20 comprises a plurality of circumferentially spaced-apart blades 22 (only one shown in FIG. 2) having a platform 23 and extending radially outwardly from a rotor disk 24.

Figure 3:
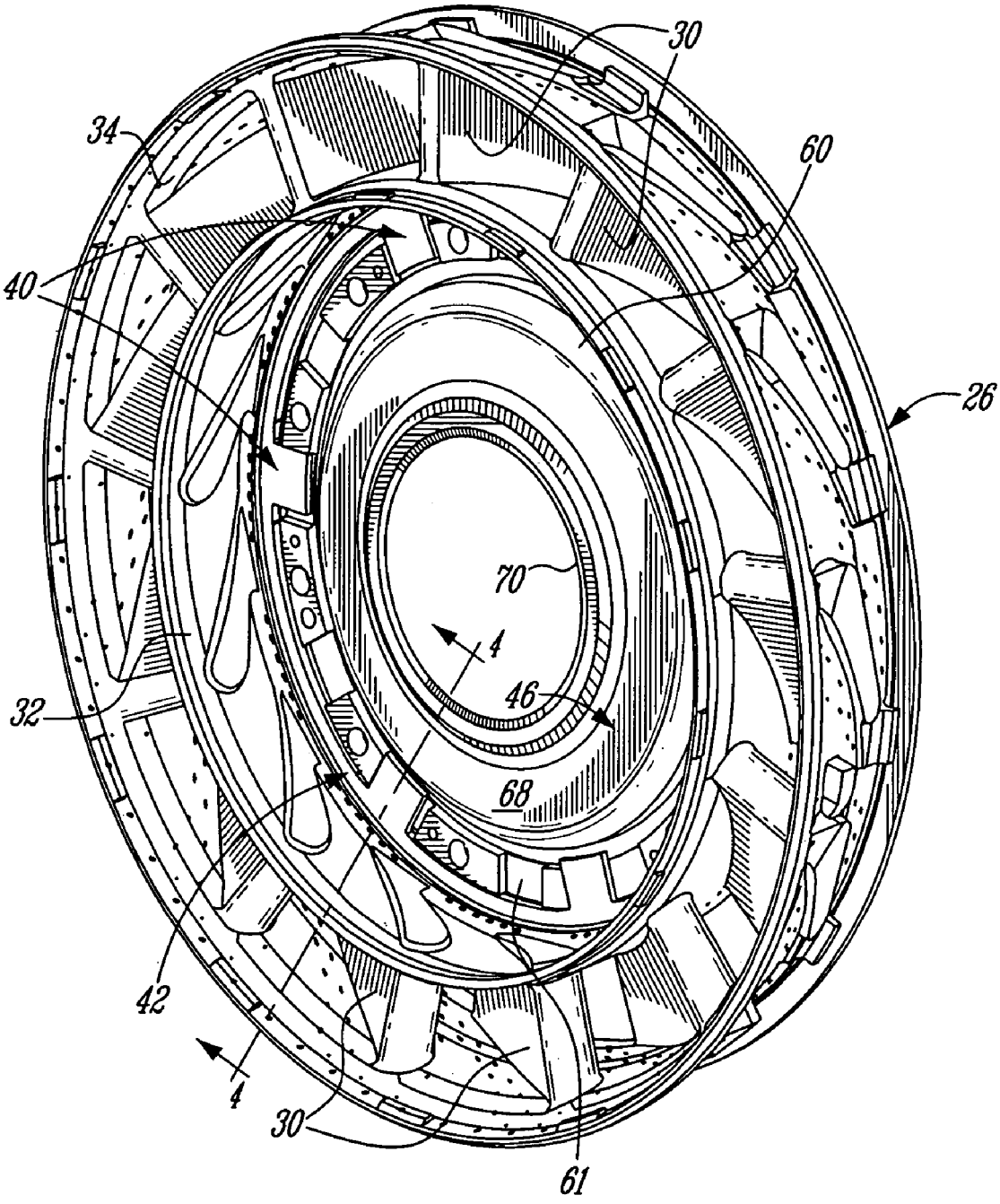
FIG. 3 is a perspective view of a unitary turbine vane ring mounted to a one piece annular support adapted to radially, axially and circumferentially restrain the turbine vane ring against movement while providing cooling air flow control in front of an adjacent rotor disk in accordance with an embodiment of the present invention.
Figure 4:
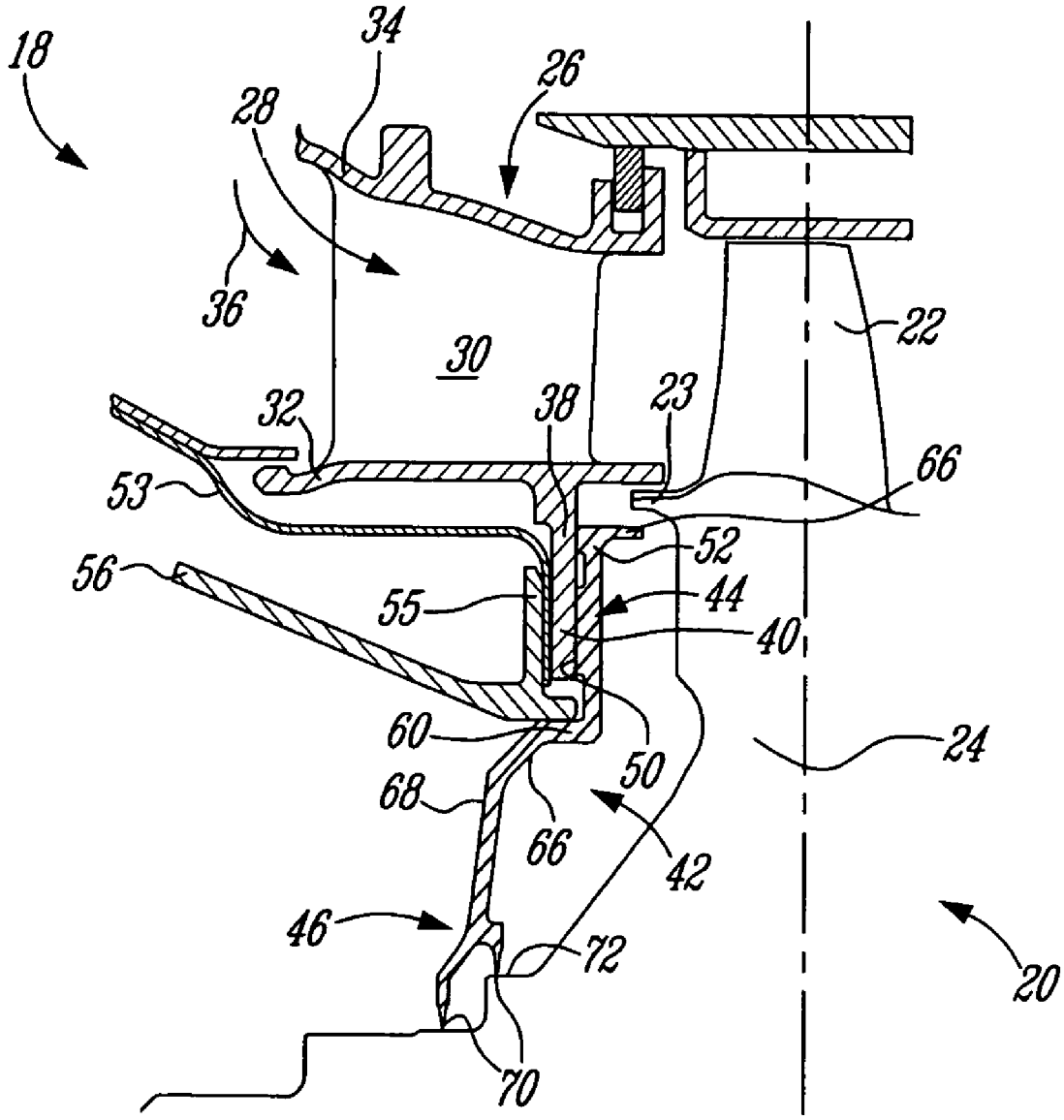
FIG. 4 is a cross-sectional view taken along line 4-4 in FIG. 3 and illustrating the details of a tongue and groove arrangement between the turbine vane ring and the one-piece annular support.

A unitary turbine vane ring or turbine nozzle 26 is provided upstream of the turbine rotor 20 to optimally direct the high pressure gases from the combustor 16 to the turbine rotor 22, as well know in the art. The turbine nozzle 26 includes a plurality of circumferentially spaced vanes 28 (only one shown in FIG. 2) having an airfoil portion 30 that extends radially between continuous inner and outer annular bands 32 and 34. The inner and outer bands 32 and 34 define the radially inner and outer flowpath boundaries for the hot gas stream flowing through the turbine nozzle 20, as represented by arrow 36. A flange 38 extends radially inwardly from the inner band 32. The flange 38 typically extends circumferentially for the full extent of the inner band 32 (i.e. over 360 degrees). As best shown in FIGS. 3 and 4, a number of circumferentially spaced-apart vane lugs 40 depend integrally radially inwardly from the flange 38.

Figure 5:
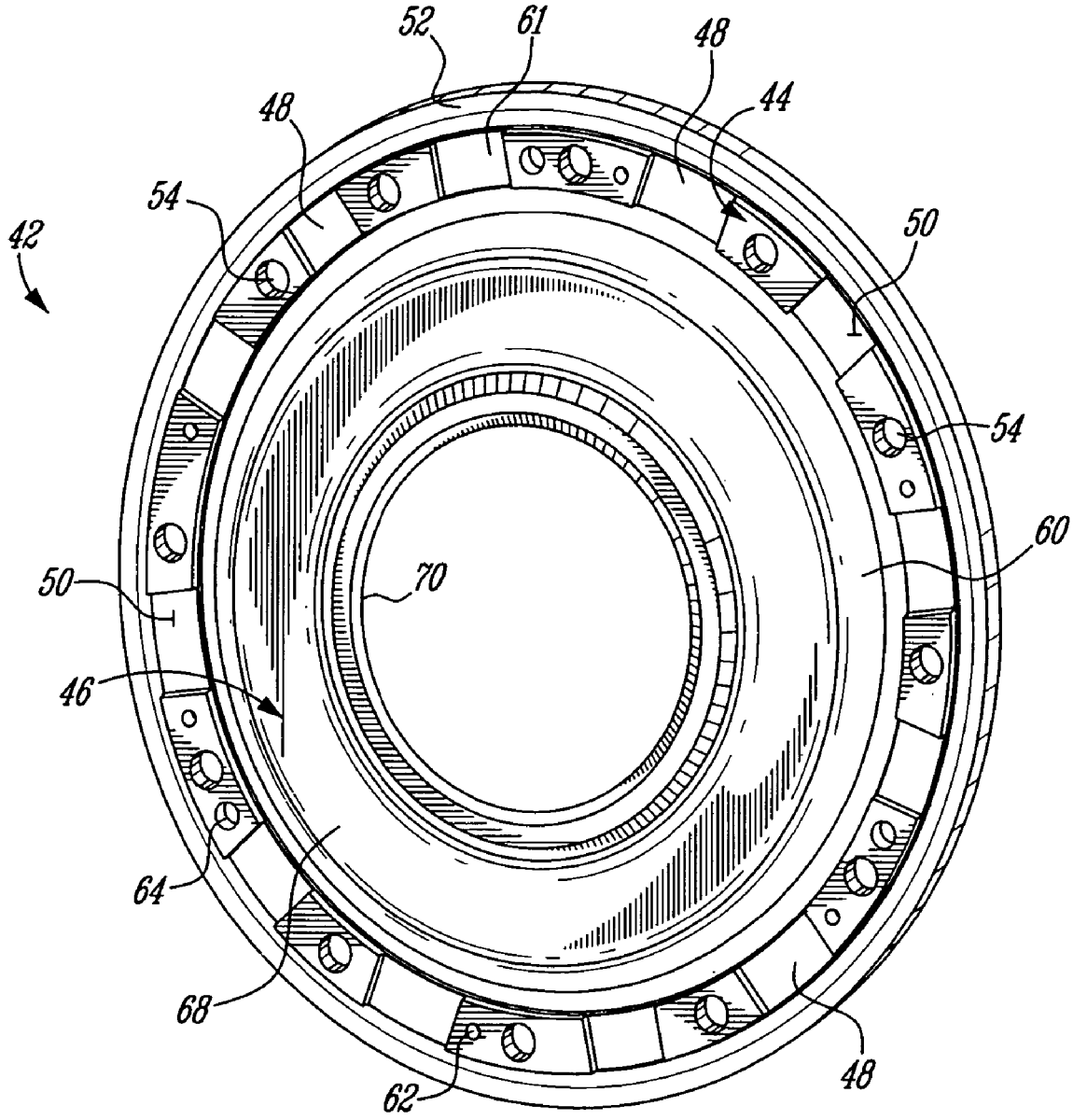
FIG. 5 is a perspective view of the annular support shown in FIG. 3.

As shown in FIG. 3, the turbine nozzle 26. is mounted to a one-piece inner support 42. As best shown in FIG. 5, the inner support 42 has a peripheral mounting ring portion 44 and an integral annular baffle portion 46 extending radially inwardly from the mounting ring portion 44. A plurality of circumferentially spaced-apart blind slots 48 (FIG. 5) are defined in the axially forwardly facing surface of the peripheral mounting ring portion 44 for receiving the vane lugs 40 in a complementary fashion, as shown in FIG. 3. The circumferentially spaced-apart blind slots 48 and the vane lugs 40 provides a tongue-and-groove joint for circumferentially and radially positioning and restraining the turbine nozzle ring 26 relative to the inner support 42.

As shown in FIGS. 4 and 5, the blind slots 48 have respective axially facing bottom surfaces 50 against which the vane lugs 40 are axially urged as a result of the axially aft force exerted on the turbine vanes 28 by the combustion gases during normal engine operation. The axially facing bottom surfaces 50, thus, provide an axially abutment or arresting surface for restraining the nozzle ring 26 against axially aft movement, thereby obviating the need to resort to a separate axially retaining plate to restrain axial vane movement, as heretofore necessitated by conventional inner ring support assemblies.

The peripheral mounting ring portion 44 is further provided with an integral annular rim 52 which extends radially outwardly of the imaginary circle on which the blind slots 50 are distributed and which is located axially aft of the flange 38 when the nozzle ring 26 is mounted to the support 42, as shown in FIGS. 2 and 4. The axially aft facing surface of the circumferentially extending flange 38 axially abuts against the front or forwardly facing surface of the rim 52 to cooperate with the bottom surfaces 50 of the blind slots 48 and the vane lugs 40 in restraining the nozzle ring 26 against axially aft movement. The rim 52 and the bottom surfaces 50 of the slots 48 forms the retaining plate portion of the inner support 42 to restrain axial vane movement. It is understood that the retaining plate portion could also be provided only by one of the rim 52 and the bottom surfaces 50.

A number of circumferentially distributed holes 54 (FIG. 5) are defined axially through the mounting ring portion 44 between the slots 48 for allowing the inner support 42 to be mounted to the outer liner 53 (FIGS. 2 and 4) of the combustor 16 and a mounting flange 55 of the engine diffuser case 56 (FIGS. 2 and 4) such as by means of bolts 58 (FIG. 2). The radial inner end of the mounting ring 48 is bent at 90 degrees to provide an axially forward projecting annular shoulder 60 for engagement underneath the diffuser case 56, as shown in FIGS. 2 and 4. This facilitates localization of the inner support 42 in the engine 10. During assembly, the unitary turbine nozzle ring 26 is mounted to the inner support 42 and, then, the inner support 42 is bolted to the diffuser case 56 and the outer liner 53. In this way, the vane lugs 40 and the flange 38 are axially held in sandwich between the inner support 42 and the diffuser case 56, thereby restraining the nozzle ring 26 against forward and aft movements. In view of the foregoing, it can be readily appreciated that the turbine nozzle ring 26 is radially, circumferentially and axially restrained against movement by a unitary component, namely the inner support 42. Indeed, only one component needs to be mounted to the engine 10 to retain the vane nozzle 26 in place therein. This advantageously contributes to simplify the assembly procedure, while providing significant tolerance savings, thereby resulting in lower manufacturing costs.

As shown in FIGS. 3 and 5, additional circumferentially spaced-apart slots 61 can be machined in the front surface of the mounting ring portion 44 of the inner support 42 to provide weight savings.

Small holes 62 (FIG. 5) are also preferably drilled at circumferentially spaced-apart locations through the mounting ring portion 44 for allowing cooling air to be fed to the front disk area of the adjacent rotor disk 24.

A number of threaded holes 64 (three in the illustrated embodiment) are also preferably provided in the front face of the mounting ring portion 44 for allowing pulling aids (not shown) to be threadably engaged with the inner support 42 when it is desired to axially pull the same out from the engine 10 for maintenance purposes or the like.

As shown in FIG. 2, an annular sealing lip 66 extends integrally axially aft from the rim 52 radially inwardly of the blade platform 23 of the adjacent turbine rotor 20 to limit hot gas ingestion from the main gas path into the cavity between the rotor disk 24 and the inner support 42.

The baffle portion 46 has a short frustoconical section 66 extending integrally radially inwardly from the annular shoulder 60 and projecting axially forwardly therefrom. The frustoconical section 66 merges into an annular flat plate section 68 extending in a plane slightly inclined relative to the mounting ring portion 44 and axially forwardly spaced-therefrom. The radially inner edge of the annular flat plate section 68 merges into a double branch sealing lip 70 extending in close proximity about a rotor surface 72 to limit cooling flow from an axially forwardly facing side of the baffle portion 60 to an axially aft facing side thereof.

By so incorporating the turbine rotor front cavity baffle to the turbine nozzle inner support, there is no need to install a separate part to split the cooling flow between the turbine nozzle 26 and the turbine rotor 20. This further contributes to reduce the assembly and disassembly time. It also provides tolerance savings, which constitutes a significant advantage for small gas turbine engines.

The above description is meant to be exemplary only, and one skilled in the art will recognize that changes may be made to the embodiments described without department from the scope of the invention disclosed. For example, the axially arresting surface of the mounting ring could be provided in the form of shoulders projecting inwardly from the opposed sides of the slots 48. As such the slots 48 could extend completely through the mounting ring portion 44. Still other modifications which fall within the scope of the present invention will be apparent to those skilled in the art, in light of a review of this disclosure, and such modifications are intended to fall within the appended claims.

The invention claimed is:

1. A unitary component for retaining a vane ring in a gas turbine engine having an axis, the unitary component comprising a retaining plate portion to restrain axial vane movement, a retaining ring portion to restrain at least one of a circumferential vane movement and a radial vane movement, and a baffle portion to split a cooling air flow between the vane and an adjacent rotor, wherein an annular sealing lip extends integrally axially aft from said mounting ring.

2. The unitary component as defined in claim 1, wherein the retaining plate portion and the retaining ring portion form part of a mounting ring having an axially facing surface in which a plurality of circumferentially spaced-apart lug slots are defined.

3. The unitary component as defined in claim 2, wherein each of said lug slots has a pair of radially extending side walls and a substantially closed axially facing base surface to provide an axially arresting surface for the vane ring.

4. The unitary component as defined in claim 2 wherein the lug slots only extend axially partly through the mounting ring.

5. The unitary component as defined in claim 2, wherein said baffle portion extends integrally radially inwardly from said mounting ring.

6. A turbine vane assembly for a gas turbine engine having an axis, comprising a one-piece vane ring mounted about an inner vane ring support via a tongue-and-groove joint, the tongue-and-groove joint including a plurality of blind grooves in an axially forwardly facing surface of the vane ring support and a plurality of corresponding lugs extending radially inwardly from the one-piece vane ring, the lugs being interconnected altogether by said one-piece vane ring, each blind groove having a pair of radially extending sidewalls projecting axially forwardly from an axially forwardly facing base surface of the groove, the lugs distributed along an inner circumference of the one-piece vane ring being received between corresponding radially extending sidewalls of the blind grooves, thereby cooperating altogether for restraining the vane ring against both circumferential and radial vane movement relative to the inner vane ring support.

7. The turbine vane assembly as defined in claim 6, wherein the inner vane ring support has a mounting ring portion in which said tongue-and-groove joint is provided and a turbine rotor front cavity baffle portion extending integrally radially inwardly from said mounting ring portion, the mounting ring portion and the turbine rotor front cavity baffle portion being of unitary construction.

8. The turbine vane assembly as defined in claim 7, wherein the baffle includes an annular rotor sealing lip.

9. The turbine vane assembly as defined in claim 6, wherein an annular sealing lip extends axially rearwardly from the inner vane ring support.

10. A turbine vane support for supporting a turbine vane ring in a gas turbine engine having an axis, comprising a mounting ring portion adapted to be coaxially mounted in the engine and having a series of circumferentially spaced-apart lug seats defined in a front surface of the mounting ring, each of said lug seats having a pair of radially extending sidewalls projecting from an axially forwardly facing base wall, and wherein the baffle extends radially inwardly from said mounting ring portion, said baffle and said mounting ring portion being integral, and wherein the baffle includes an annular rotor sealing lip.

11. The turbine vane support as defined in claim 10, wherein an annular sealing lip extends axially rearwardly from said mounting ring.

12. The turbine vane support as defined in claim 10, wherein a plurality of circumferentially spaced-apart blind slots are defined in said front surface of said mounting ring portion to form said lug seats.

13. A turbine vane support in combination with a one-piece turbine vane ring coaxially mounted about an axis, the one-piece turbine vane ring having a plurality of circumferentially spaced-apart vane lugs extending radially inwardly from a common inner annular band extending along a full turn, the inner vane ring support having a plurality of circumferentially spaced-apart blind slots defined in an axially forwardly facing surface thereof for receiving the vane lugs in a tongue-and-groove fashion, each blind slots having a pair of radially extending sidewalls defining a gap for receiving a corresponding one of said vane lugs therebetween and an axially forwardly facing surface, the lugs in the slots cooperating altogether to both circumferentially and radially restrained relative motion between the one-piece turbine vane ring and the turbine vane support.

14. The combination as defined in claim 13, wherein said blind slots are defined in a mounting ring portion of said inner vane ring support, and wherein a baffle extends integrally radially inwardly from said mounting ring portion.

15. The combination as defined in claim 13, wherein an annular sealing lip extends integrally axially rearwardly from said inner vane ring support.

16. A unitary vane ring for use with an annular support having a plurality of circumferentially spaced-apart blind slots defined in a front surface thereof, each of said blind slots having a pair of sidewalls projecting forwardly from an axially facing surface of the slot, the sidewalls defining a gap having a width ($W_1$); the unitary vane ring comprising a plurality of circumferentially spaced-apart vanes having an airfoil portion extending radially between one-piece inner and outer annular bands, and a plurality of circumferentially spaced-apart vane lugs, each of said vane lugs having a pair of opposed side edges extending radially inwardly from said inner annular band, the vane lugs being circumferentially distributed along the inner annular band, the inner annular band forming a common base for said vane lugs, the side edges of said lugs being spaced by a width ($W_2$) generally corresponding to the width ($W_1$) of the blind slots, said vane lugs adapted to be received in tongue-and-groove engagement in said blind slots, and in circumferential arresting contact with the sidewalls of the blind slots-and cooperating altogether to restrain relative radial motion between the vane ring and the annular support.

* * * * *